US008403170B1

(12) United States Patent
Lai

(10) Patent No.: US 8,403,170 B1
(45) Date of Patent: Mar. 26, 2013

(54) PRESSURE VESSEL

(76) Inventor: Ming-Yu Lai, Taichung (TW)

( * ) Notice: Subject to any disclaimer, the term of this patent is extended or adjusted under 35 U.S.C. 154(b) by 0 days.

(21) Appl. No.: 13/451,919

(22) Filed: Apr. 20, 2012

(51) Int. Cl.
*F17C 5/02* (2006.01)
*B65D 25/04* (2006.01)

(52) U.S. Cl. ..... 220/581; 220/721; 220/720; 220/723

(58) Field of Classification Search ..... 220/586, 220/581, 720, 721, 723, 584, 592, 565, 529, 220/530, 601, 574, 4.12; 138/30, 26
See application file for complete search history.

(56) References Cited

U.S. PATENT DOCUMENTS

| | | | | | |
|---|---|---|---|---|---|
| 3,174,658 | A * | 3/1965 | Wittenberg et al. | 222/386.5 |
| 3,236,411 | A * | 2/1966 | Lander et al. | 220/721 |
| 3,425,593 | A * | 2/1969 | Zirps et al. | 220/721 |
| 3,931,834 | A * | 1/1976 | Caillet | 138/30 |
| 4,214,611 | A * | 7/1980 | Takacs et al. | 138/30 |
| 4,252,151 | A * | 2/1981 | Haug et al. | 138/30 |
| 4,351,363 | A * | 9/1982 | Haug et al. | 138/30 |
| 4,595,037 | A * | 6/1986 | LeBreton et al. | 138/30 |
| 4,667,841 | A * | 5/1987 | Belle | 220/530 |
| 5,117,873 | A * | 6/1992 | Miyakawa et al. | 138/30 |
| 5,176,178 | A * | 1/1993 | Schurter et al. | 138/30 |
| 5,368,073 | A * | 11/1994 | Murphy | 138/30 |
| 5,386,925 | A * | 2/1995 | Lane | 220/530 |
| 5,778,679 | A * | 7/1998 | Celorier et al. | 62/47.1 |
| 6,041,820 | A * | 3/2000 | Boehme | 138/30 |
| 6,199,717 | B1 * | 3/2001 | Tsai | 220/723 |
| 6,401,966 | B2 * | 6/2002 | Tsai | 220/723 |
| 6,915,922 | B2 * | 7/2005 | Wang | 220/720 |
| 6,994,228 | B2 * | 2/2006 | Yoshihara et al. | 220/723 |
| 7,216,673 | B2 * | 5/2007 | Gremour et al. | 138/30 |
| 8,033,416 | B2 * | 10/2011 | Wang | 220/584 |
| 8,079,126 | B2 * | 12/2011 | Bampton et al. | 29/463 |
| 2004/0173624 | A1 * | 9/2004 | Carter | 220/720 |
| 2005/0017016 | A1 * | 1/2005 | Lombari | 220/721 |
| 2011/0309084 | A1 * | 12/2011 | Wang | 220/530 |

* cited by examiner

*Primary Examiner* — Steven A. Reynolds
(74) *Attorney, Agent, or Firm* — Stewart & Irwin, P.C.; Dennis S. Schell; Bassam S. Nader

(57) ABSTRACT

A pressure vessel includes: an outer container unit having an inner space and first and second supporting portions; a lining container disposed inside the outer container unit and having an end portion that corresponds to the first supporting portion; an elastic diaphragm disposed in and dividing the inner space into air and water chambers, and having retaining and extending sectors that correspond in position to the end portion and the second supporting portion respectively; and a pressing member disposed in the air chamber and having first and second pressing segments that press tightly the retaining sector and the end portion against the first supporting portion and the extending sector on the second supporting portion respectively.

4 Claims, 3 Drawing Sheets

PRESSURE VESSEL

BACKGROUND OF THE INVENTION

1. Field of the Invention

The invention relates to a pressure vessel, more particularly to a pressure vessel having a structure for preventing deformation of a lining container therein.

2. Description of the Related Art

Hydro-pneumatic pressure vessels are widely used in industrial and residential piping systems. For example, hydro-pneumatic pressure vessels are used for stabilizing water pressure and absorbing water hammers in hydraulic piping systems, absorbing thermal expansion in closed hot water systems and storing water in reverse osmosis systems.

As shown in FIG. 1, a pressure vessel disclosed in Taiwanese Patent Publication No. 533,905 includes an outer container 1, a plastic lining container 2 sleeved by the outer container 1, and an elastic diaphragm 4 having an end portion that is clamped between an end portion of the lining container 2 and a pressing member 3. The diaphragm 4 divides an inner space of the outer container 1 into an air chamber 6 and a water chamber 5 that corresponds to the lining container 2. Despite being widely used, the above-mentioned pressure vessel suffers from a drawback: coupling between the outer container 1 and the lining container 2 is not air-tight, such that high-pressure air in the air chamber 6 may leak into a space between the outer container 1 and the lining container 2. Once the pressure in the water chamber 5 drops suddenly to be much smaller than the pressure in the space between the outer container 1 and the lining container 2, the lining container 2 may deform toward the water chamber 5. The deformation of the lining container 2 may be irreversible and may have an adverse effect on performance of the pressure vessel.

SUMMARY OF THE INVENTION

Therefore, the object of the present invention is to provide a pressure vessel having a structure for preventing deformation of a lining container therein.

Accordingly, a pressure vessel of the present invention comprises:

an outer container unit having a surrounding wall that surrounds an axis, and first and second end walls that are spaced apart from each other along the axis and that cooperate with the surrounding wall to define an inner space, the surrounding wall having a first supporting portion and a second supporting portion, the first supporting portion being disposed between the second supporting portion and the first end wall;

a lining container disposed inside the first outer container and disposed to contact the first end wall and a portion of the surrounding wall, and having an end portion that corresponds in position to the first supporting portion;

an elastic diaphragm disposed in the inner space, and dividing the inner space into an air chamber and a water chamber that corresponds to the lining container, the diaphragm having a retaining sector that corresponds in position to the end portion of the lining container, and an extending sector that is connected to the retaining sector and that corresponds in position to the second supporting portion of the surrounding wall; and a pressing member surrounding the axis, disposed in the air chamber, and having a first pressing segment that presses tightly the retaining sector of the diaphragm and the end portion of the lining container against the first supporting portion of the surrounding wall, and a second pressing segment that presses tightly the extending sector of the diaphragm against the second supporting portion of the surrounding wall.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
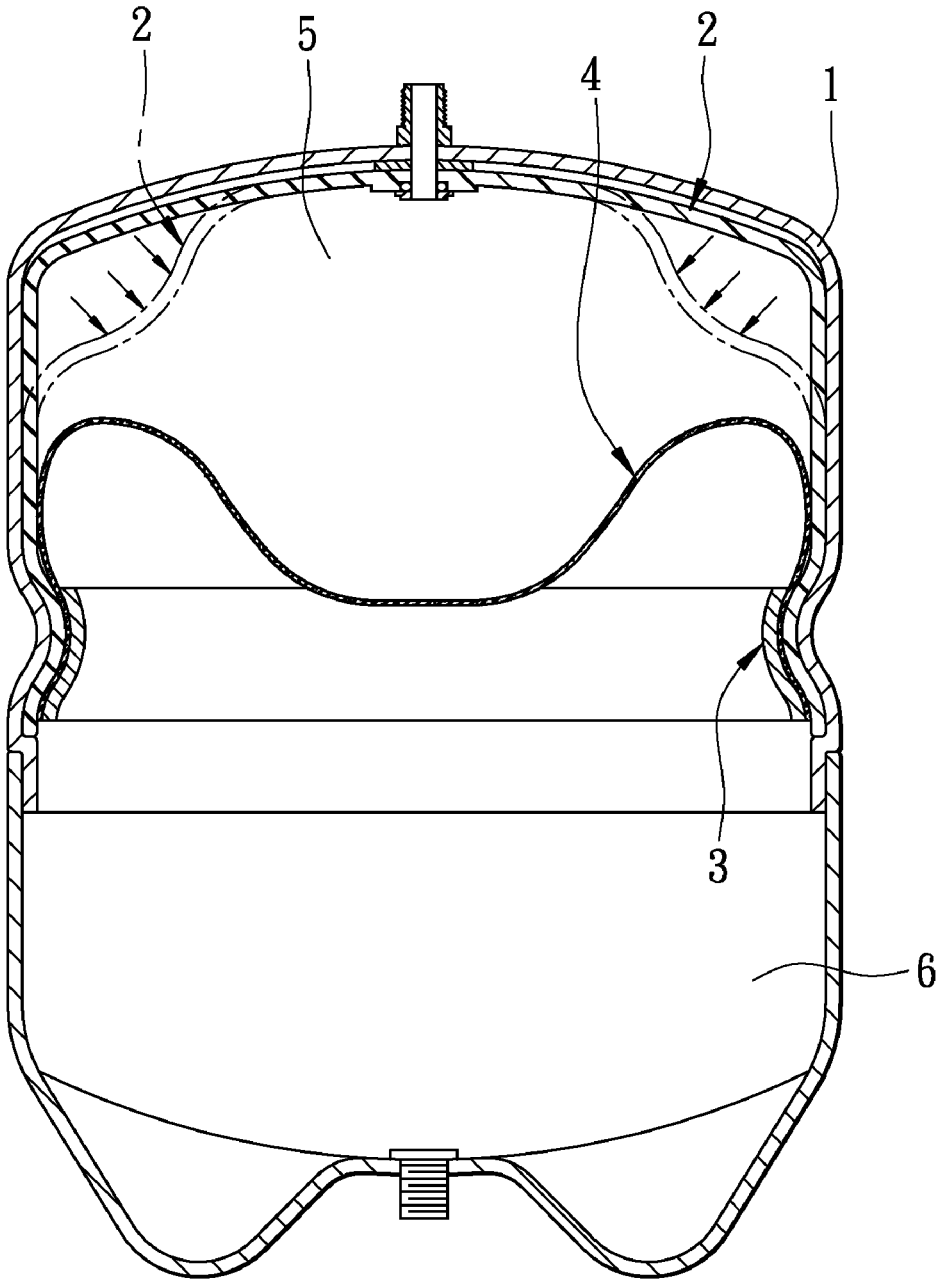
FIG. 1 PRIOR ART
FIG. 1 is a sectional view of a conventional pressure vessel having a lining container.
Figure 2:
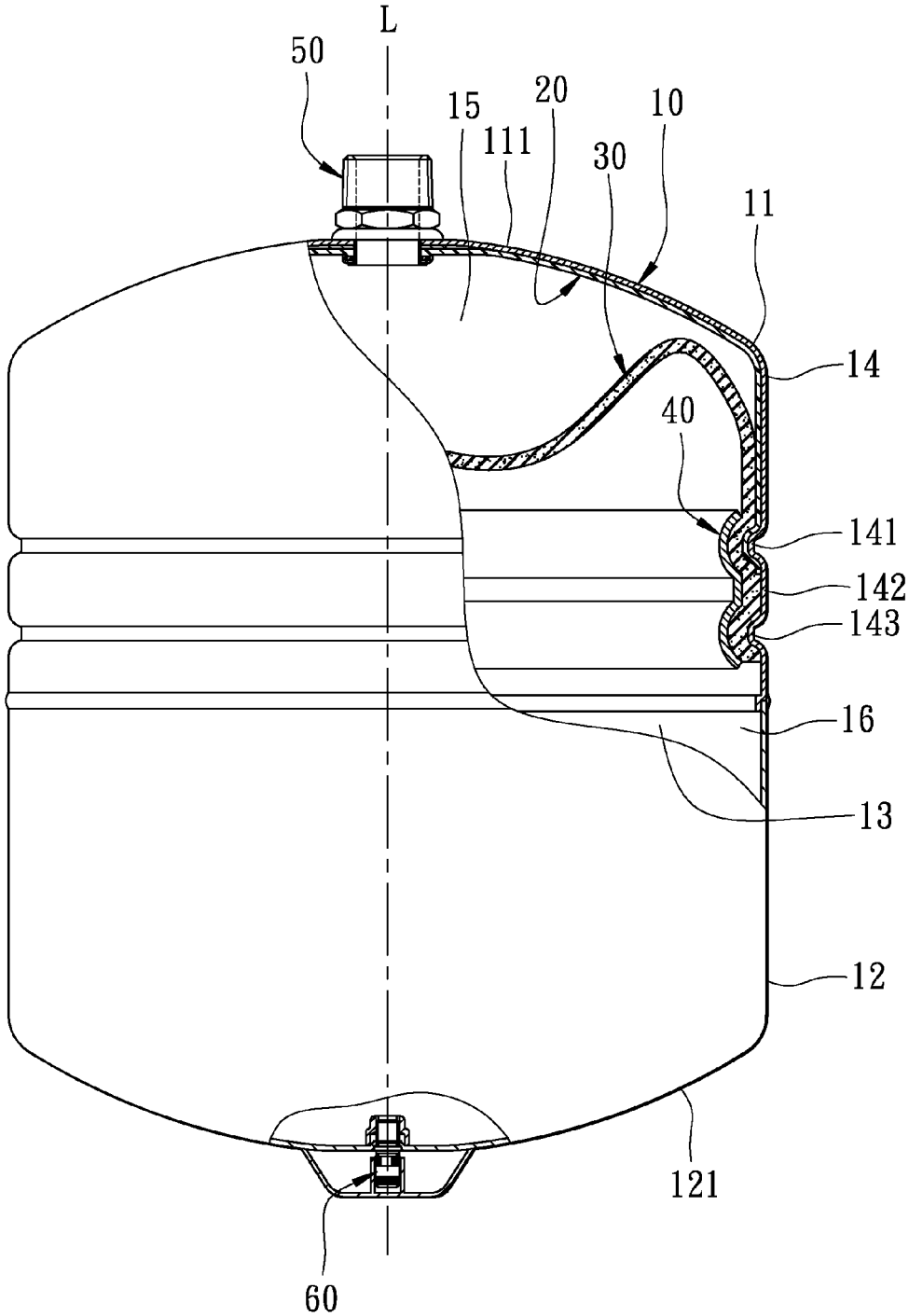
FIG. 2 is a partly sectional view of a preferred embodiment of a pressure vessel according to the invention.
Figure 3:
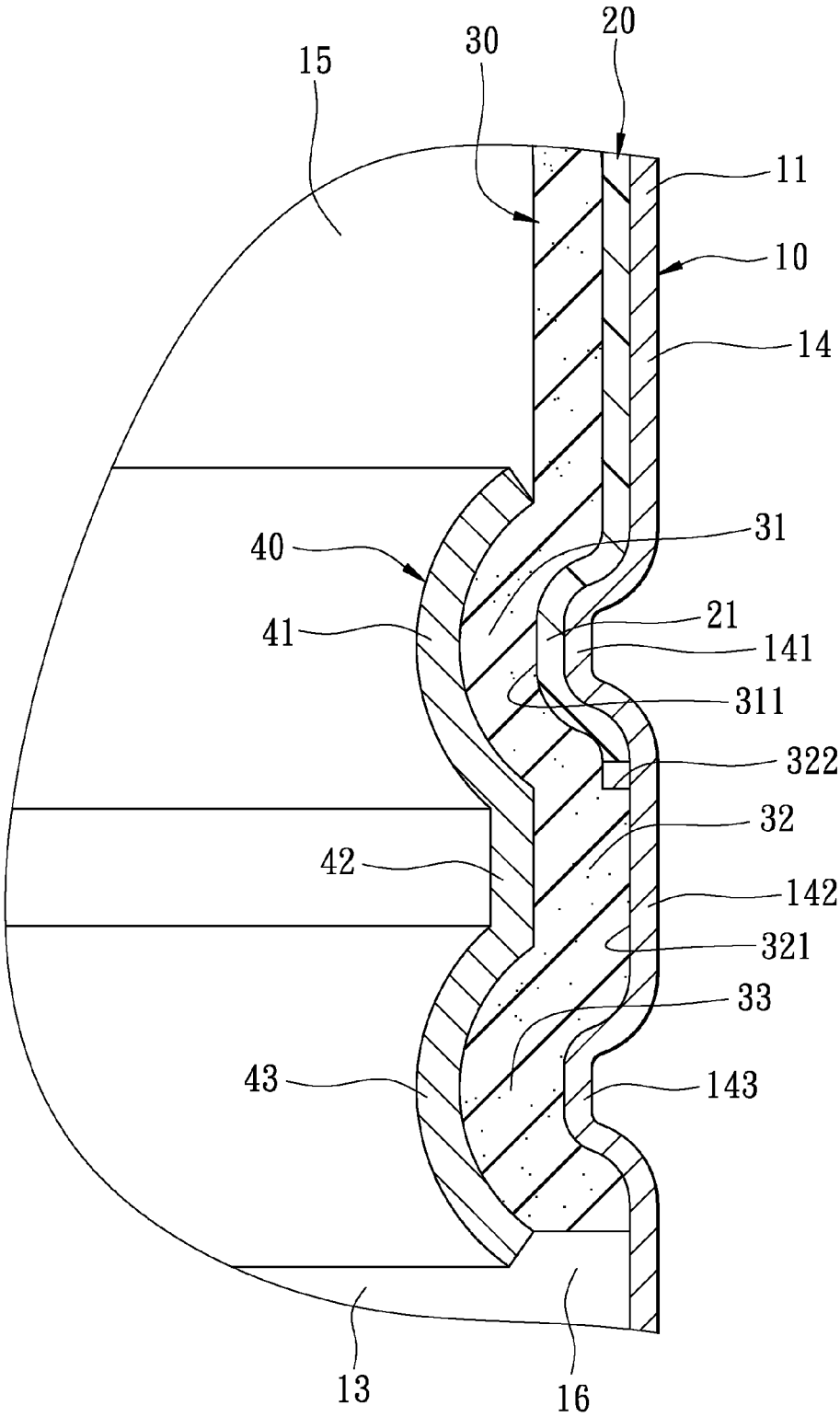
FIG. 3 is an enlarged fragmentary sectional view of the preferred embodiment.

As shown in FIGS. 2 and 3, a preferred embodiment of a pressure vessel according to the present invention comprises an outer container unit 10, a lining container 20, an elastic diaphragm 30, a pressing member 40, a water fitting 50 and an air valve 60.

The outer container unit 10 has a surrounding wall 14 that surrounds an axis (L), and first and second end walls 111, 121 that are spaced apart from each other along the axis (L), that are connected to opposite ends of the surrounding wall 14, and that cooperate with the surrounding wall 14 to define an inner space 13. The outer container unit 10 includes a first container body 11 and a second container body 12 that is welded to the first container body 11. The abovementioned first and second end walls 111, 121 are formed respectively in the first and second container bodies 11, 12, while the surrounding wall 14 is formed in the first and second container bodies 11, 12. The surrounding wall 14 has an annular first supporting portion 141 and an annular second supporting portion 142 located in the first container body 11. The first supporting portion 141 is disposed between the second supporting portion 142 and the first end wall 111.

Preferably, the surrounding wall 14 of the outer container unit 10 further has an annular third supporting portion 143 that is formed at one side of the second supporting portion 142 opposite to the first supporting portion 141 along the axis (L). Both of the first and third supporting portions 141, 143 are inwardly-curved.

The lining container 20 is disposed inside the outer container 10 and disposed to entirely contact the first end wall 111 and a portion of the surrounding wall 14, and has an annular end portion 21 that is inwardly-curved with respect to the axis (L) and that corresponds in position to the first supporting portion 141 of the surrounding wall 14.

The diaphragm 30 is made of rubber, and is disposed in the inner space 13 and divides the inner space 13 into an air chamber 16 and a water chamber 15 that corresponds to the lining container 20. The diaphragm 30 has a retaining sector 31 that corresponds in position to the end portion 21 of the lining container 20, and an extending sector 32 that is connected to the retaining sector 31 and that corresponds in position to the second supporting portion 142 of the surrounding wall 14. The retaining sector 31 has a retaining surface 311 that is in contact with the end portion 21 of the lining container 20, the extending sector 32 has a thickness larger than that of the retaining sector 31 and has a contact surface 321 that is in contact with the second supporting portion 142 of the surrounding wall 14, and the diaphragm 30 further has a shoulder portion formed between the retaining and extending sectors 31, 32 and having a shoulder surface 322 that confronts a distal end of the end portion 21 of the lining container 20.

Preferably, the diaphragm 30 further has a stop sector 33 connected to the extending sector 32 and corresponding in position to the third supporting portion 143 of the surrounding wall 14.

The pressing member 40 is disposed in the air chamber 16, surrounds the axis (L), and has an annular first pressing segment 41 and an annular second pressing segment 42.

The first pressing segment 41 is disposed to press tightly the retaining sector 31 of the diaphragm 30 and the end portion 21 of the lining container 20 against the first supporting portion 141 of the surrounding wall 14.

The annular second pressing segment 42 is disposed to press tightly the extending sector 32 of the diaphragm 30 against the second supporting portion 142 of the surrounding wall 14. Both the first pressing segment 41 and the retaining sector 31 of the diaphragm 30 are inwardly-curved with respect to the axis (L).

Preferably, the pressing member 40 further has an annular third pressing segment 43 connected to the second pressing segment 42, corresponding in position to the stop sector 33 of the diaphragm 30, and pressing the stop sector 33 against the third supporting portion 143 of the surrounding wall 14. The third pressing segment 43 and the stop sector 33 are both inwardly-curved with respect to the axis (L).

The water fitting 50 is disposed on the first container body 11 and communicates fluidly with the water chamber 15.

The air valve 60 is disposed on the second container body 12 and communicates fluidly with the air chamber 16.

Since the contact surface 321 of the extending sector 32 of the diaphragm 30 is in contact with the second supporting portion 142 of the surrounding wall 14 of the outer container unit 10, and the extending sector 32 is pressed tightly against the second supporting portion 142 by the second pressing segment 42 of the pressing member 40, the lining container 20 and the outer container unit 10 are coupled air-tightly to each other, and the configuration of the third pressing member 43, the stop sector 33, and the third supporting portion 143 further reinforces the coupling between the lining container 20 and the outer container unit 10. Hence, high-pressure air in the air chamber 16 would not escape into a space between the lining container 20 and the outer container unit 10. That is, when a pressure in the water chamber 15 drops suddenly, the lining container 20 is prevented from deforming toward the water chamber 5, such that performance of the pressure vessel is maintained.

During manufacturing of the pressure vessel, the outer container unit 10, the lining container 20, the elastic diaphragm 30, and the pressing member 40 are assembled before the inwardly-curved structures (the first pressing segment 41, the retaining sector 31, the end portion 21, the first supporting portion 141, the third pressing segment 43, the stop sector 33, and the third supporting portion 143) are formed by rolling. At that time, the shoulder portion of the diaphragm 30 would abut against the end portion 21 of the lining container 20 for positioning adequately the diaphragm 30 relative to the lining container 20 and the outer container unit 10.

It should be noted that the air valve 60 may be omitted in a modification in which inflation of the air chamber 16 is achieved through sublimation of solid carbon dioxide in the air chamber 16. Moreover, the third supporting portion 143 of the surrounding wall 14 of the outer container unit 10, the stop sector 33 of the diaphragm 30, and the third pressing segment 43 of the pressing member 40 may also be omitted without significantly compromising the capability of the preferred embodiment to achieve the desired effect of relatively improved airtightness between the lining container 20 and the outer container unit 10.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A pressure vessel comprising:

an outer container unit having a surrounding wall that surrounds an axis, and first and second end walls that are spaced apart from each other along the axis and that cooperate with said surrounding wall to define an inner space, said surrounding wall having a first supporting portion and a second supporting portion, said first supporting portion being disposed between said second supporting portion and said first end wall;

a lining container disposed inside said outer container unit and disposed to contact said first end wall and a portion of said surrounding wall, and having an end portion that corresponds in position to said first supporting portion;

an elastic diaphragm disposed in said inner space, and dividing said inner space into an air chamber and a water chamber that corresponds to said lining container, said diaphragm having a retaining sector that corresponds in position to said end portion of said lining container, and an extending sector that is connected to said retaining sector and that corresponds in position to said second supporting portion of said surrounding wall; and a pressing member surrounding the axis, disposed in said air chamber, and having a first pressing segment that presses tightly said retaining sector of said diaphragm and said end portion of said lining container against said first supporting portion of said surrounding wall, and a second pressing segment that presses tightly said extending sector of said diaphragm against said second supporting portion of said surrounding wall; wherein:

each of said first supporting portion of said outer container unit, said end portion of said lining container, said retaining sector of said diaphragm, and said first pressing segment of said pressing member is annular and inwardly-curved;

said surrounding wall of said outer container unit further has a third supporting portion formed at one side of said second supporting portion opposite to said first supporting portion along the axis;

said diaphragm further has a stop sector connected to said extending sector and corresponding in position to said third supporting portion of said surrounding wall of said outer container unit;

said pressing member further has a third pressing segment connected to said second pressing segment, corresponding in position to said stop sector of said diaphragm, and pressing said stop sector of said diaphragm on said third supporting portion of said surrounding wall of said outer container unit; and each of said third supporting portion of said outer container unit, said stop sector of said diaphragm, and said third pressing segment of said pressing member is annular and inwardly-curved.

2. The pressure vessel as claimed in claim 1, wherein:

said retaining sector of said diaphragm has a retaining surface contacting said end portion of said lining container;

said extending sector of said diaphragm has a thickness larger than that of said retaining sector and has a contact surface contacting said second supporting portion of said surrounding wall of said outer container unit; and said diaphragm further has a shoulder portion formed between said retaining and extending sectors and having a shoulder surface that confronts a distal end of said end portion of said lining container.

3. The pressure vessel as claimed in claim 1, wherein:

said outer container unit includes a first container body and a second container body welded to said first container body;

said first and second end walls are formed respectively in said first and second container bodies;

said surrounding wall is formed in said first and second container bodies; and said first and second supporting portions are located in said first container body.

4. The pressure vessel as claimed in claim 3, further comprising a water fitting disposed on said first container body and communicating fluidly with said water chamber, and an air valve disposed on said second container body and communicating fluidly with said air chamber.

* * * * *